US005899772A

United States Patent [19]

Beaver et al.

[11] Patent Number: 5,899,772

[45] Date of Patent: May 4, 1999

[54] SHIELDING FOR AN ELECTRICAL CONNECTOR

[75] Inventors: Kris Eilene Beaver, Harrisburg; Denver Harley Wilson, Palmyra, both of Pa.

[73] Assignee: The Whitaker Corporation, Wilmington, Del.

[21] Appl. No.: 08/806,305

[22] Filed: Feb. 26, 1997

[51] Int. Cl.[6] ..... H01R 13/648

[52] U.S. Cl. ..... 439/610; 439/607

[58] Field of Search ..... 439/610, 609, 439/608, 607, 98

[56] References Cited

U.S. PATENT DOCUMENTS 4,961,711 10/1990 Fujiura et al. ..... 439/610
5,409,400 4/1995 Davis ..... 439/610
5,456,618 10/1995 Nakamura ..... 439/610
5,505,637 4/1996 Krämer et al. ..... 439/610
5,518,421 5/1996 Davis ..... 439/607

*Primary Examiner*—Khiem Nguyen
*Assistant Examiner*—Eugene G. Byrd
*Attorney, Agent, or Firm*—Gerald K. Kita

[57] ABSTRACT

A pair of stamped and formed backshells (1, 19) engage a front shell (6) to provide shielding for an electrical connector (5), a nest (4) on one of the backshells (1), a second of the backshells (19) covering the nest (4), inward flaps (11) on the nest (4) restrain an electrical connector (5) from forward movement in the nest (4) and provide additional points of contact with the front shell (6), and raised bumps (13) on the nest (4) to restrain an electrical connector (5) from rearward movement in the nest (4).

5 Claims, 5 Drawing Sheets

SHIELDING FOR AN ELECTRICAL CONNECTOR

FIELD OF THE INVENTION

The invention relates to a shielding for an electrical connector, and, more particularly, to a shielding front shell and a pair of shielding backshells for enclosing an electrical connector.

BACKGROUND OF THE INVENTION

As disclosed in U.S. Pat. No. 5,409,400, shielding for an electrical connector comprises a front shell and a pair of backshells that engage the front shell. The connector terminates multiple conductors of an electrical cable. The backshells are matched in size to the connector to be shielded. When the connector is changed to a connector having a smaller size, the connector of smaller size will fit in the backshells. However the connector of smaller size is free to shift in position while in the backshells. In the past, smaller backshells were constructed to confine the smaller connector.

SUMMARY OF THE INVENTION

The invention relates to shielding for a connector wherein backshells have interior features that restrain a connector from movement. A connector that would fit loosely within the backshells is restrained by these interior features. By moving the positions of these interior features, the backshells can accommodate different sizes of connectors without having to change the size of the backshells.

Embodiments of the invention will now be described by way of example with reference to the accompanying drawings, according to which:

DETAILED DESCRIPTION

Figure 1:
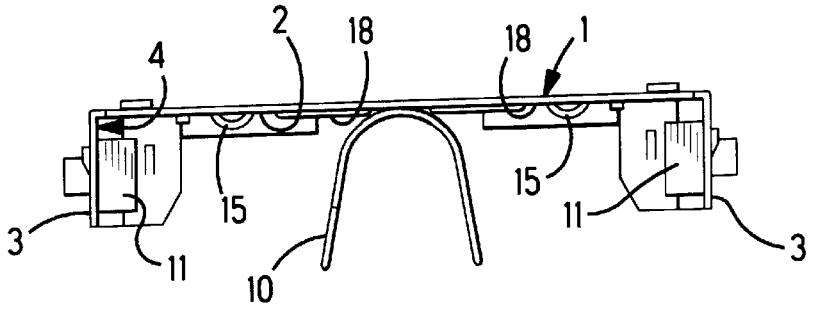
FIG. 1 is a front view of a conducting backshell.
Figure 2:
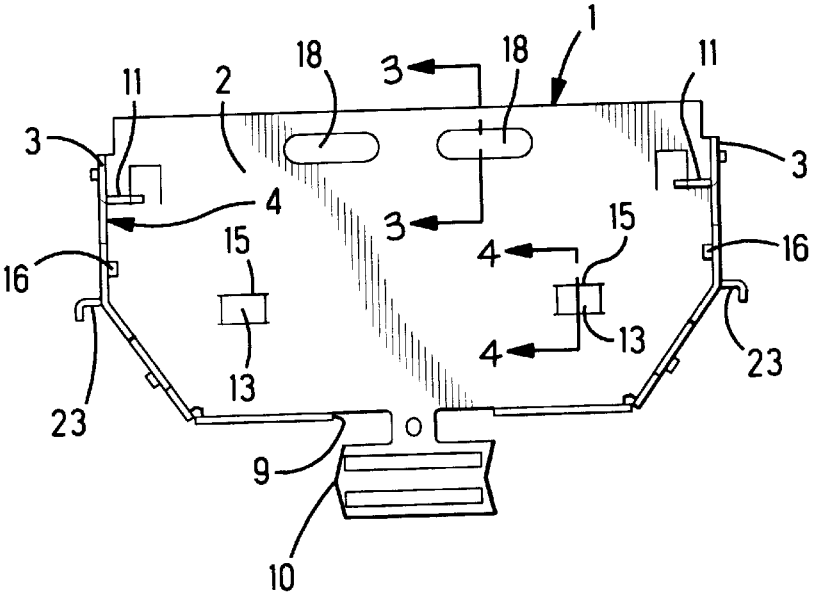
FIG. 2 is a top view of the backshell, as shown in FIG. 1, and further illustrating a nest.
Figure 3:
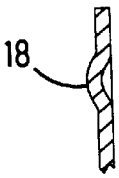
FIG. 3 is a section view taken along the line 3—3 of FIG. 2.
Figure 11:
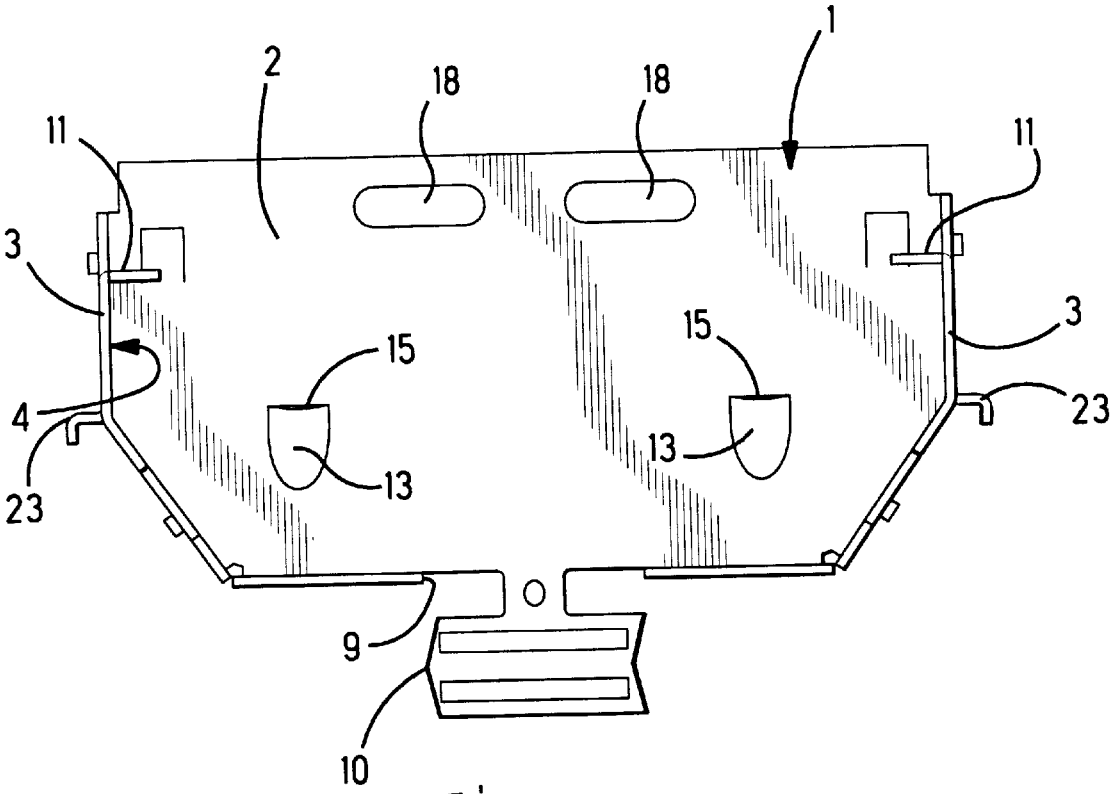
FIG. 11 is a top view of the backshell as shown in FIG. 10, and further illustrating a nest.
Figure 12:
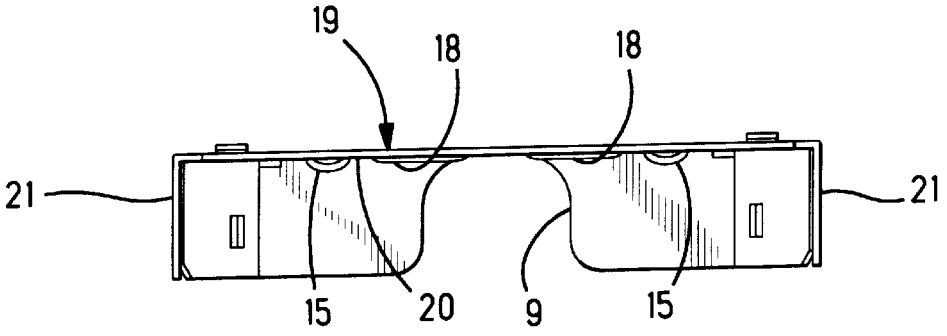
FIG. 12 is a front view of a conducting backshell providing a cover for the backshell shown in FIG. 10.
Figure 16:
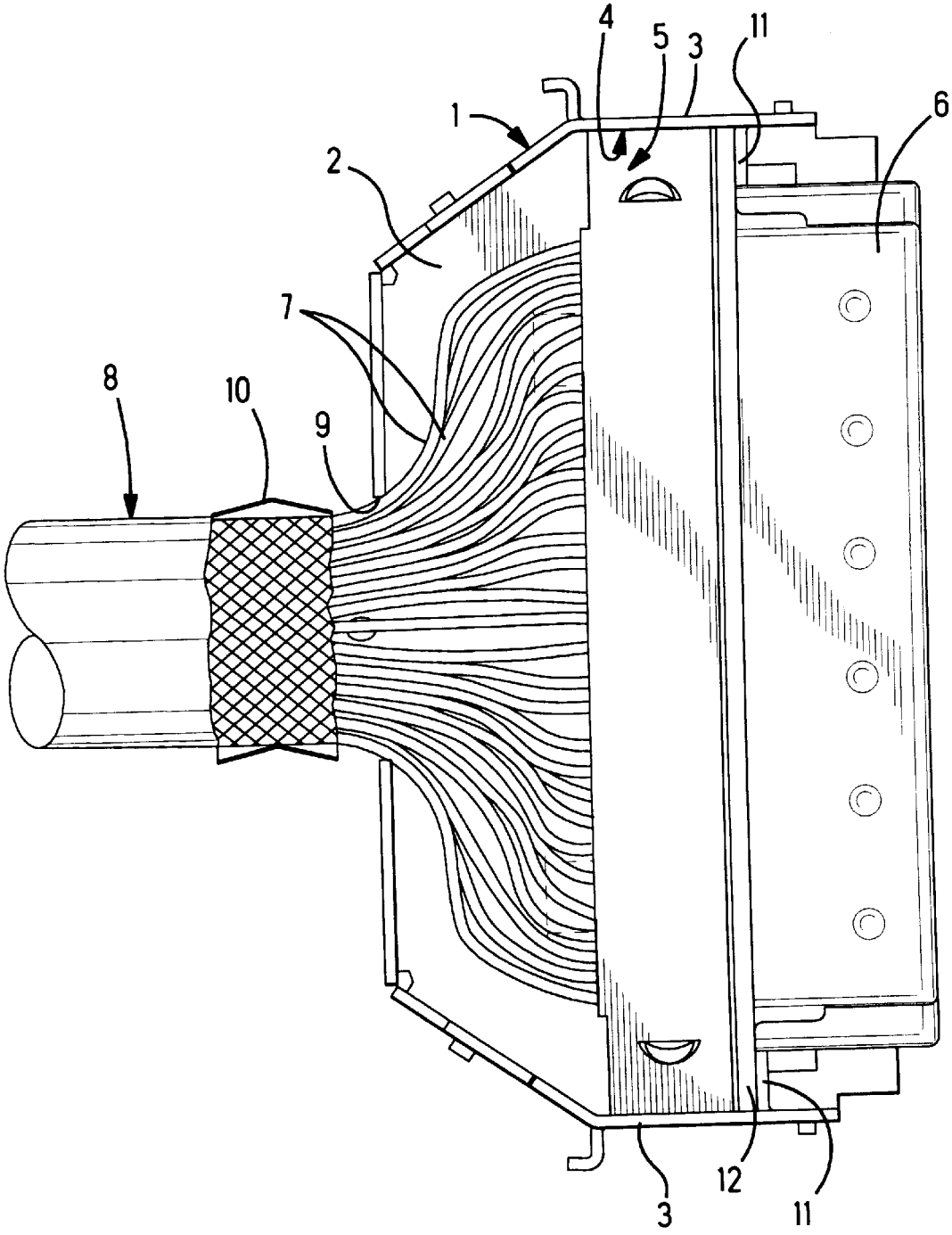
FIG. 16 is a top view of a nest as shown in FIG. 1 together with an electrical connector terminating multiple conductors of an electrical cable.

With reference to FIGS. 2 and 11, two conducting backshells 1 will now be described with similar features. Each backshell 1 is of unitary construction stamped and formed from a sheet of metal. The backshell 1 has a bottom wall 2 and upstanding side walls 3, 3 forming a nest 4 for an electrical connector 5, FIG. 16. A conducting front shell 6 encircles a mating end of the connector 5. The connector 5 terminates multiple conductors 7 of an electrical cable 8. A cable exit opening 9 extends through a rear of the nest 4. A unitary cable receiving strain relief 10 at the cable exit opening 9 projects rearward of the nest 4. The strain relief 10 gathers the conductors 7 of the cable 8. The strain relief 10 can be closed to encircle and to grip conducting shielding surrounding the conductors 7.

An object of an embodiment of the invention is restrain an electrical connector 5 from forward movement in the nest 4. Opposite side walls 3, adjacent to an open front end of the nest 4, are bent inward to provide cantilever inward flaps 11 on the nest 4 to register with the front shell 6. The inward flaps 11 are cantilever beams that overlap the front shell 6 and restrain forward movement of the connector 5 in the nest 4. The inward flaps 11 engage the front shell 6 to provide an electrical connection. The inward flaps 11 register against a conducting flange 12 on the front shell 6.

Figure 4:
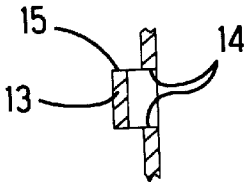
FIG. 4 is a section view taken along the line 4—4 of FIG. 2.

An object of one embodiment of the invention is to restrain an electrical connector 5 from rearward movement in the nest 4. Raised bumps 13 on the bottom wall 2 of the nest 4 register with a rear of an electrical connector 5 in the nest 4 and restrain an electrical connector 5 from rearward movement in the nest 4. Each of the bumps 13 comprises a bulge in the bottom wall 2 of the nest 4. The bottom wall 2 has at least one slit 14 for each bump 13. The bump 13 has a bulged edge 15 adjacent a corresponding slit 14 to register against a rear of a connector 5, FIG. 16, received in the nest 4. The bumps 13 bias the connector 5 forwardly to exert pressure contact against the cantilever inward flaps 11. In the embodiment of FIG. 2, the bottom wall 2 has a slit 14 in two places for each bump 13. Each bump 13 bulges between corresponding slits 14, FIG. 4.

Figure 5:
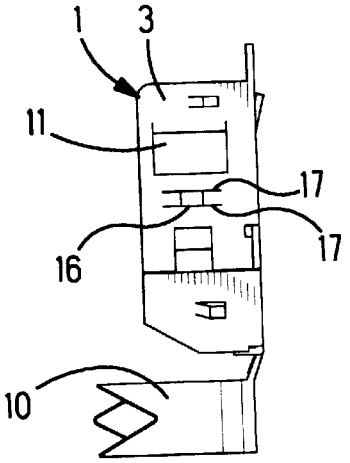
FIG. 5 is a side view of the backshell as shown in FIG. 2.
Figure 6:
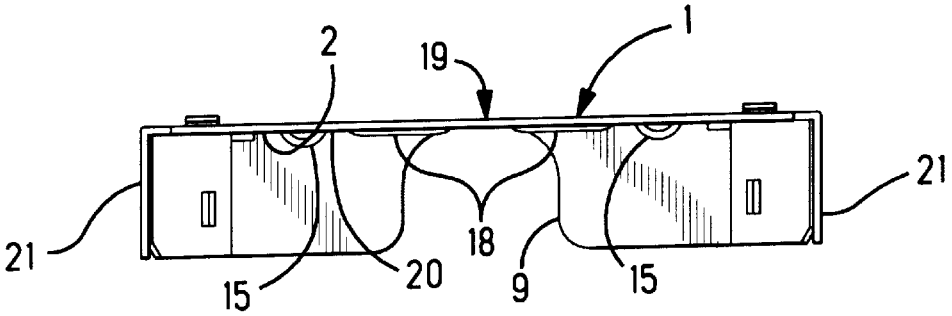
FIG. 6 is a front view of a conducting backshell providing a cover for the backshell shown in FIG. 2.

An object of one embodiment of the invention is to center an electrical connector 5 in the nest 4. With reference to FIG. 5, opposite side walls 3 are indented with raised ribs 16 on the nest 4. The ribs 16 are bulges between respective pairs of slits 17 in the side walls 3. The ribs 16 are rearward of the inward flaps 11. The ribs 16 engage opposite sides of the connector 5, FIG. 16, to center an electrical connector 5 in the nest 4. Adjacent the open front end of the nest 4, raised ribs 18 on the bottom wall 2 provide wiping contact surfaces along the mating end of the backshell 1.

Figure 7:
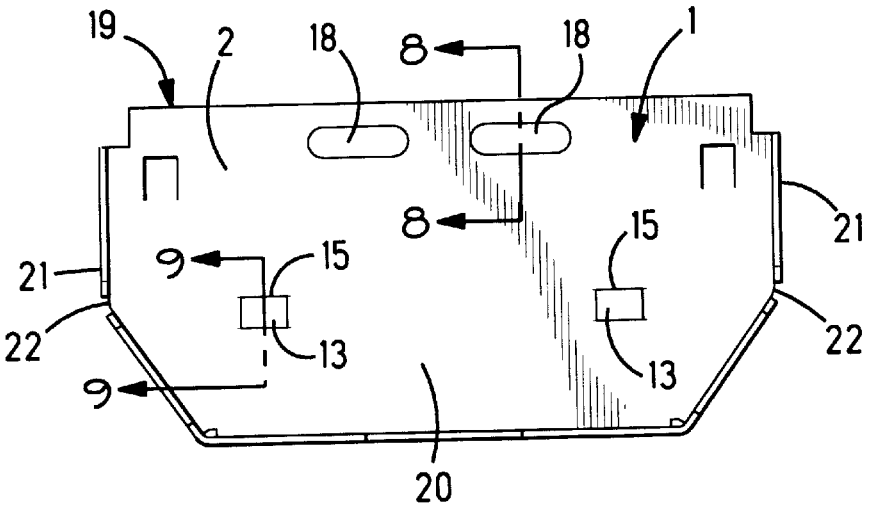
FIG. 7 is a top view of the backshell as shown in FIG. 6.
Figure 8:
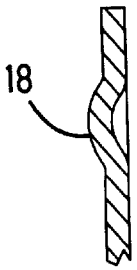
FIG. 8 is a section view taken along the line 8—8 of FIG. 7.
Figure 9:
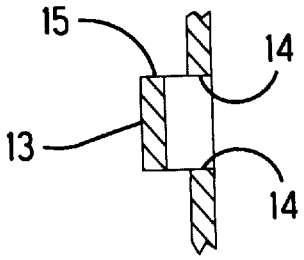
FIG. 9 is a section view taken along the line 9—9 of FIG. 7.
Figure 10:
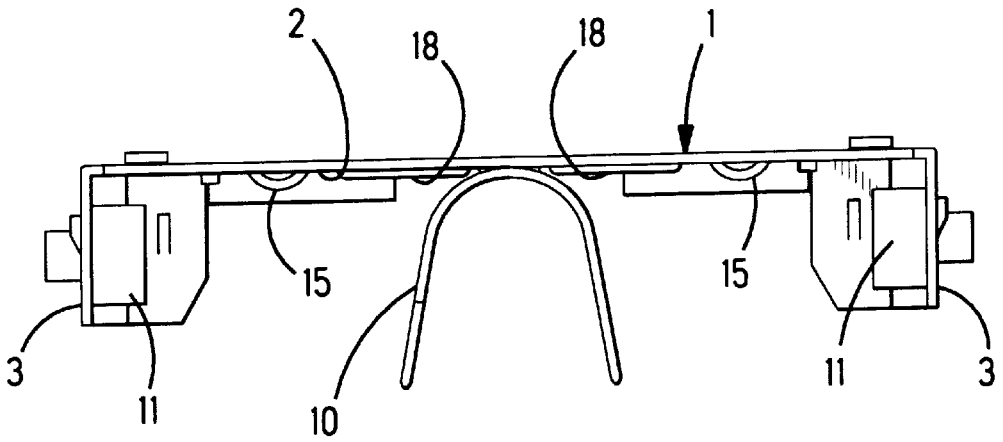
FIG. 10 is a front view of a conducting backshell.
Figure 13:
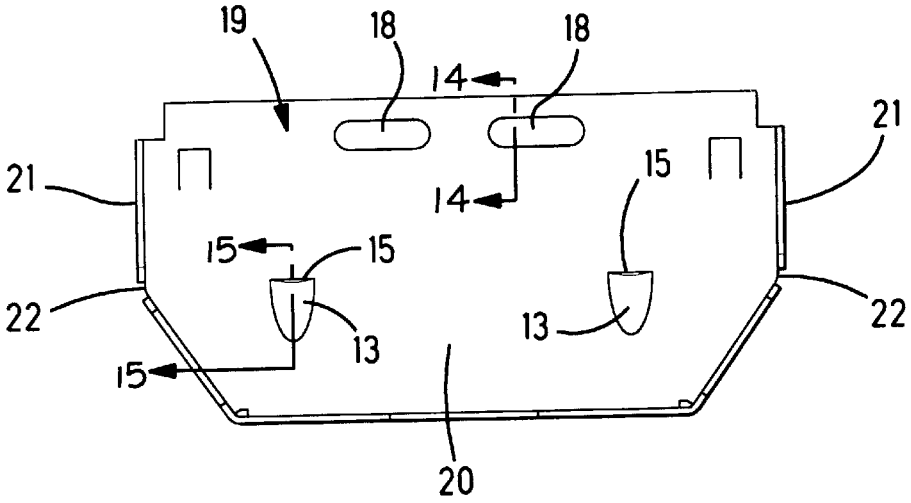
FIG. 13 is a top view of the conducting backshell as shown in FIG. 12.
Figure 15:
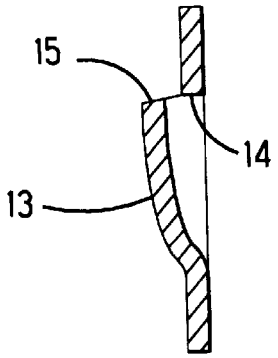
FIG. 15 is a section view taken along the line 15—15 of FIG. 13.
Figure 14:
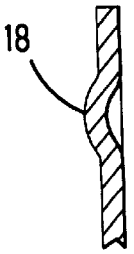
FIG. 14 is a section view taken along the line 14—14 of FIG. 13.

With reference to FIGS. 7 and 13, two conducting backshells 19 will now be described with similar features. Each backshell 19 is of unitary construction stamped and formed from a sheet of metal. The backshell 19 has a bottom wall forming a cover 20 for a corresponding nest 4. The backshells 1, 19, of FIGS. 2 and 7, form a matched pair of backshells 1, 19 for enclosing an electrical connector 5. The backshells 1, 19, of FIGS. 11 and 13, form a matched pair of backshells 1, 19 for enclosing an electrical connector 5. Each of the backshells 19 of FIGS. 7 and 13 have unitary upstanding side walls 21 on the cover 20 for encircling the nests 4 of respective backshells 1, 1 shown in FIGS. 2 and 7. Slots 22 through the side walls 21, FIGS. 7 and 13, receive projecting tabs 23, FIGS. 2 and 11, on the exterior of the nests 4. Each cover 20 of the backshells 19, 19 of respective FIGS. 11 and 13, further has a cable exit opening 9 and the bumps 13 and the ribs 18, described previously with reference to the nests 4.

The connector 5 may fit loosely within the nest 4. The backshells 1, 19 can be manufactured with different positions for the interior features of the flaps 4, the bumps 13 and the ribs 16. These interior features can be adjusted to match different sizes of connectors, to eliminated the costly need for different sizes of backshells 1, 19.

The interior features comprising, the flaps 4, the bumps 13 and the ribs 16, can be manufactured in different positions to restrain different sizes of connectors 5. The advantage is that each of the backshells 1, 19 of one size adapts to connectors having different sizes.

Although preferred embodiments of the invention have been described, other embodiments and modifications of the invention are intended to be covered by the spirit and scope of the appended claims.

What is claimed is:

1. Shielding for an electrical connector comprising: a front shell for encircling a mating end of the connector, a pair of stamped and formed backshells for enclosing an electrical connector and establishing electrical contact with the front shell, a nest on one of the backshells for an electrical connector, a cable exit opening through a rear of the nest, a unitary cable receiving strain relief at the cable exit opening, a second of the backshells having a cover for covering the nest, and unitary side walls on the cover for encircling the nest, and the improvement comprising: inward flaps on the nest to register with the front shell and restrain an electrical connector from forward movement in the nest, and raised bumps on the nest to register with a rear of an electrical connector in the nest and to restrain an electrical connector from rearward movement in the nest, the positions of said bumps being variable to register with rears of connectors of different sizes and to adapt each of the backshells of one size to connectors of different sizes.

2. Shielding for an electrical connector as recited in claim 1 wherein, the inward flaps are on sidewalls of the nest, and the inward flaps register against a flange on the front shell.

3. Shielding for an electrical connector as recited in claim 1 wherein, additional raised bumps on the cover register with a rear of an electrical connector in the nest and restrain an electrical connector from rearward movement in the nest.

4. Shielding for an electrical connector as recited in claim 1 and further comprising: raised ribs on the nest engaging opposite sides of an electrical connector in the nest to center the electrical connector in the nest, the positions of the ribs being variable to register with sides of connectors of different sizes and to adapt each of the backshells of one size to connectors of different sizes.

5. Shielding for an electrical connector comprising: a front shell for encircling a mating end of the connector, a pair of stamped and formed backshells for enclosing an electrical connector and establishing electrical contact with the front shell, a nest on one of the backshells for an electrical connector, a cable exit opening through a rear of the nest, a unitary cable receiving strain relief at the cable exit opening, a second of the backshells having a cover for covering the nest, and unitary side walls on the cover for encircling the nest, and the improvement comprising: raised ribs on the nest engaging opposite sides of an electrical connector in the nest to center the electrical connector in the nest, the positions of the ribs being variable to register with sides of connectors of different sizes and to adapt each of the backshells of one size to connectors of different sizes.

* * * * *